US006698650B2

(12) United States Patent
Laker et al.

(10) Patent No.: US 6,698,650 B2
(45) Date of Patent: Mar. 2, 2004

(54) OPENING MEANS FOR GABLE TOP CONTAINER

(75) Inventors: Jonathan Paul Laker, Felixstowe (GB); Kirk Anthony Laker, Felixstowe (GB)

(73) Assignee: Easycarton Limited, London (GB)

( * ) Notice: Subject to any disclaimer, the term of this patent is extended or adjusted under 35 U.S.C. 154(b) by 0 days.

(21) Appl. No.: 10/055,385

(22) Filed: Jan. 22, 2002

(65) Prior Publication Data

US 2002/0066777 A1 Jun. 6, 2002

Related U.S. Application Data

(60) Continuation of application No. 09/678,072, filed on Oct. 3, 2000, now abandoned, which is a division of application No. 08/945,462, filed as application No. PCT/GB96/01221 on May 21, 1996, now Pat. No. 6,142,364.

(51) Int. Cl.[7] ..... B65D 5/74
(52) U.S. Cl. ..... 229/160.2; 229/125.42
(58) Field of Search ..... 229/160.2, 125.42, 229/213, 917, 214, 249, 920, 924, 87.05

(56) References Cited

U.S. PATENT DOCUMENTS 4,874,126 A * 10/1989 Miller ..... 229/160.2
4,883,222 A * 11/1989 Fujisawa ..... 229/160.2
4,890,758 A * 1/1990 Gailus ..... 220/270
4,982,845 A * 1/1991 Prascak et al. ..... 206/621
5,333,735 A * 8/1994 Focke et al. ..... 206/494
5,353,985 A * 10/1994 Nageli et al. ..... 229/123.1
6,142,364 A * 11/2000 Laker et al. ..... 229/160.2
6,427,908 B1 * 8/2002 Laker et al. ..... 229/160.2

FOREIGN PATENT DOCUMENTS

GB 2253608 * 9/1992 ..... B65D/5/06

* cited by examiner

*Primary Examiner*—Tri M. Mai
(74) *Attorney, Agent, or Firm*—Charles D. Gunter, Jr.

(57) ABSTRACT

A boxed end container is shown having one end closed by a transverse ridge seal and carrying a pull tab. The pull tab allows a separating force to be applied to the ridge seal of the sealed container to separate at least part of the ridge seal and thus open the container and allow discharge of its contents. The pull tab is a generally planar member having an axially extending shank member with a proximal end portion which can be gripped and pulled by a user and a distal end portion having foot members extending transversely to each side of thereof. The shank and foot members are substantially co-planar with one another. The pull tab is secured by the foot members externally to a wall of the container at or adjacent to the ridge seal of the container.

7 Claims, 5 Drawing Sheets

OPENING MEANS FOR GABLE TOP CONTAINER

CROSS REFERENCE TO RELATED APPLICATIONS

The present application is a continuation of Ser. No. 09/678,072, filed Oct. 3, 2000 ABN, which is a divisional of application Ser. No. 08/945,462, filed Feb. 6, 1998, (now U.S. Pat. No. 6,142,364) which was the National Stage of International Application No. PCT/GB96/01221, filed May 21, 1996.

BACKGROUND OF THE INVENTION

1. Field of the Invention

The present invention generally relate to a pull tab for assisting opening of a sealed boxed end openable container.

2. Description of the Prior Art

Many materials, notably fluids such as milk or fruit juices, are put up in sealed containers for transport and storage prior to use when the container is opened and the contents discharged. Many forms of containers are used for this purpose, but one form is a thin walled carton made from a thin card or plastic sheet material and having a generally squared or rectangular cross-section and a cuboid or brick-like overall shape. The contents of such a container are typically fed to the container through an open top end of the container, the other end being having been closed by folding over the basal portion of the side walls to form a boxed end to the container. When the desired amount of material has been fed to the container, the open top of the container is closed by forming transversely directed V folds in the upper portions of two opposed side walls, with the apexes of the Vs directed inwardly towards one another. This has the effect of bringing the top portions of the other two side walls of the container together to form a tented top to the container having a ridge lying along the line of indentation of the V folds. The ridge is then heat sealed or otherwise processed so as to secure together the opposed faces of the upper portions of the V folded and other side walls in a single linear transverse strip seal closure to the container, at least the major portion of the closure being located within the overall cross-sectional plan area of the container.

The sealed ridge is often then folded down about a transverse fold line located extending across approximately the midpoint of one of the side walls of the tented top, so as to form a flat boxed end to the container. In some forms of such a closure, a tape, which can be wire-reinforced, is included in the line of the ridge, for example during folding over of the ridge material. This tape extends beyond the ends of the ridge to provide extensions which can be bent over to secure the folded down ridge in position by engaging the free ends of the tape under the lip formed along the edge of the boxed end where the V folded portion of the container wall is indented. Alternatively, the free ends of the extensions can be adhered or otherwise secured to the side walls of the container once the ridge has been folded down to form a boxed end to the container.

For convenience, the following terms will have the following means herein:

boxed end openable containers are containers of the above described general type and will be referred to herein as such containers;

ridge seal will be used to denote the transverse linear seal between the opposed faces of the top end portions of the side walls of the container;

ridge will be used to denote the exposed top edge of the ridge seal or the edges of the wall material which has been brought together prior to forming the ridge seal;

ridge structure will be used to denote the structure formed by bringing together the top end portions of the gabled and tent side walls of the container and which are secured together by adhesion between opposing faces at the interface between those opposing faces to form the ridge;

gabled end will be used to denote the structure formed at the top end of the container by indenting the upper portions of two opposed side walls of the container to form the ridge to that end of the container;

tented end will be used to denote the end of the container with the ridge in the raised position either before or after forming the ridge seal;

gabled side walls will be used to denote the upper portions of the two opposed side walls of the end of the container which have been indented by forming a V or other axial fold in the upper portion of the side wall so that the wall is collapsed laterally inwardly to form the gabled end to the container;

tent side walls will be used to denote the two opposed side walls of the sealed top which extend between the gabled side walls of the gabled end of the container;

wet wall surface will be used to denote an internal surface of the container which is to be in contact with the contents of the container, including the upper portions of walls which are to be incorporated into the ridge seal;

dry wall surface will be used herein to denote an external surface of the container which is not in contact with the contents of the container, including the upper portions of walls which are to be incorporated into the ridge seal.

To open such a boxed end openable container, the seal at the interface between the opposing dry wall surfaces of the V fold at one end of the linear ridge seal is separated. This forms a pair of wings in the gabled end so that the plan view configuration from above of the ridge seal to the container adopts a Y shaped configuration in place of a single line seal. The top edges of the wings forming the head of the Y remain sealed together. The wings are then bent backward to lie in line with each other, ie. so that the plan view configuration from above of the ridge seal adopts a T shaped configuration with the wings forming the head of the T. The free ends of the wings are then pressed inwardly towards the centre line of the upright of the T to apply a separating force transverse to the line of the seal at the intersection of the head and the upright of the T. This causes the seal between the opposed faces of the wet walls at the top edges of the container to separate at this intersection and to form an opening through which the contents of the container can be discharged. In some cases it may be desired to bend the wings beyond the in-line configuration so as to enhance the separating force applied to the seal at the intersection upon the application of pressure to the free ends of the wings.

However, separation of the seal is often incomplete and/or the wings collapse so that the user cannot continue to apply the separating force to the seal. It is therefore usually necessary for the user to insert a fingertip into the initial opening formed at the intersection to assist full separation of the seal between the faces of the wet walls to allow the V fold in the wall of the container to be unformed and then inverted to form a spout outlet to the container.

In many cases the initial separation of the seal between the wet walls at the intersection is insufficient to form an aperture into which the user can insert a finger tip. It is then necessary for the user to pinch the dry wall material in the unfolded gabled end wall of the container in the region of the V fold and try to pull the wall outwardly to assist separation of the seal. Such separation of the seal may occur abruptly, causing spillage of the contents of the container, and the need for such additional operations to separate the ridge seal is inconvenient.

Notwithstanding these problems in forming the opening to the container, the boxed end openable container provides a simple and effective container for the storage and transport of a wide range of fluids and remains widely used.

We have now devised a form of pull tab which can be secured to the exterior of the container wall and pulled by a user to apply a transverse separation force to the ridge seal whilst still in its linear or T or Y configuration. This separates the opposed faces of the wet walls of the ridge seal from one another to open the container. The form of the pull tab of the invention can be surprisingly firmly secured to the wall and resists removal from the wall of the container when the pull tab is pulled by a user to provide a container which is remarkably easy to open and is less prone to partial separation of the ridge seal than previous designs of pull tab or container.

The pull tab of the invention can readily be incorporated into the structure of the container with little or no modification to the container manufacturing and filling processes, notably where the pull tab is applied to the flat blank of card or plastic from which the container is to be formed. Thus, the pull tab of the invention can be applied to a container, which is assembled, filled and sealed using conventional techniques and machinery.

SUMMARY OF THE INVENTION

Accordingly, the present invention provides a generally planar pull tab suitable for application to the exterior wall of a boxed end openable container having one end formed by in-folding the terminal portions of opposed side walls so as to form a transverse ridge structure at that end of the container, the ridge structure being retained in the closed configuration by bonding together the opposed faces of the wall material in the ridge structure so as to form a ridge seal closure to the container, or for application to a blank for use in the manufacture of such a container, and by which pull tab a force can be applied by a user to the ridge seal of such a container carrying the pull tab so as to apply a transverse separating force to the ridge seal closure of the container and thus cause separation of the ridge seal to open the container and thus permit discharge of the contents of the container, characterised in that the pull tab comprises:

a shank member extending longitudinally between a proximal end adapted to be grasped by a user and a distal end adapted to be secured to a wall of the container or of the blank, said shank member having two longitudinally extending edges thereto; t least two foot members by which the distal end of the shank member is adapted to be secured to the wall of the container or blank, said foot members extending transversely one from each of said longitudinal edges of the shank member to provide foot members extending substantially symmetrically from the distal end of the shank member, said foot members each having a proximal edge which extends from the shank member intermediate the proximal and distal ends of the shank member;

he angle included between the said proximal edge of the foot member and the longitudinal edge of the shank member where the foot member joins the shank member being less than 90 whereby the foot members extend axially towards both the proximal and distal ends of the shank member about said join; and said pull tab is made from a sheet material having a surface which can be fused with or otherwise adhered to the wall material of said container or blank.

The invention also provides a boxed end openable container or a blank for use in the construction of such a container which carries a pull tab of the invention secured to a wall thereof.

The pull tab is a separate component, which is secured at the desired location to the exposed wall of the container or blank. The use of a separate component allows the use of materials other than those from which the container walls are made and allows flexibility in the location and method of securing the pull tab to the container.

Preferably, the pull tab is applied to the tent side wall of the container and/or to the adjacent ridge structure and for convenience, the invention will be described hereinafter in terms of the mounting of the pull tab of the invention on a container at such a position. We have found that the pull tab can then be used to open the container without the tearing, cutting or other rupturing of the tent side wall of the container required in earlier proposals for opening boxed end containers. The term without rupture is used in this context to denote that the tent side wall remains intact and is not torn or otherwise separated into component parts during opening of the container as with the design of U.S. Pat. No. 5,067,613.

It is also preferred that the pull tab be attached to the side tent wall at a point at or adjacent the foot of the ridge seal so that it causes bowing of the tent side wall and enhances the upward peel force applied to the foot of the ridge seal. Preferably, the pull tab is secured to the tent side wall from 1 to 15, notably 2 to 5, mms below the foot of the ridge seal.

The pull tab is preferably located at or adjacent, typically within 5 to 10% of the length of the ridge seal to either side of, the axial line passing through the portion of the linear ridge seal located between the apexes of the V folds in the gable ends of the sealed container, which will itself usually be located at the mid-point along the length of the ridge seal.

The pull tab of the invention has a shank member which extends longitudinally between the proximal end, which is to be grasped and pulled by a user to separate the ridge seal and open the container, and a distal end by which the pull tab is secured to the wall of the container or blank. This proximal end can be formed with transverse ridges to provide a grip surface or can be formed with a finger hole through which the user inserts his finger tip.

The proximal end is connected to or forms part of the shank member, which is typically a continuation of the shape of the proximal end but may be of any suitable form, shape and length. The shank member extends longitudinally for sufficient length to allow the user to grip the free proximal end of the pull tab and to apply tension to the pull tab by a rolling action using the knuckles of his hand resting against the lower portion of the tent side wall of the container to which the pull tab is secured as the fulcrum. This enables the user to open the container using a simple single handed action.

The other, or distal, end of the shank member of the pull tab is provided with transverse extensions or feet, which extend laterally from the longitudinal edges of the shank member to increase the area of contact between the distal end of the shank member of the pull tab and the container wall. Each foot member extends laterally, one to each side of the shank member. The foot members preferably extend for the length of the ridge seal of the container to which the pull tab is to be secured.

The foot members are provided with one or more axial extensions thereto as continuations of the foot members and preferably also with one or more lateral extensions to the foot members. The axial extensions extend proximally about the point at which the proximal edge of the foot member intersects the longitudinal edge of the shank member intermediate the proximal and distal ends of the shank member. In this case, it will be appreciated that the angle $\underline{\alpha}$ included between the longitudinal edge of the shaft member and the proximal edge of the axial extension where the foot member joins the shaft member is less than 90°.

It is particularly preferred to provide at least part of the distal edge of the foot with an axially distal extension. This distal extension extends into the V fold of the ridge seal itself when the pull tab is secured in position adjacent the foot of the ridge seal of the container. This extension provides an area of weakness between the dry wall faces in this area of the ridge seal. However, it is preferred that such an extension does not extend for the full height of the ridge seal when secured to the container, for example for from 25 to 75% of that height, so that a seal can be formed between the opposing faces of the ridge material at the upper edge of the ridge.

It is preferred that the axial and distal extensions to the foot members have a generally triangular or part triangular shape.

It is particularly preferred that the foot member also extends laterally beyond the length of the ridge seal of the container to which it is to be secured so that the ends of the foot members extend around the lateral corners at the edge of the tent side wall and into the V folds of the linear ridge seal in the assembled container, for example for quarter to half the transverse length of the V fold. We have found that by extending the foot of the pull tab into the interface between the opposing surfaces of the dry walls of the V fold, application of tension to the pull tab applies not only a separating force transversely to the ridge seal in the region of the apexes of the V folds, but also causes the application of a compressive force along the line of the ridge seal and a separating force to the seal between the opposing surfaces of the dry walls of the V fold in the gabled ends of the container assisting bowing of the tent side wall and separation of the ridge seal. Furthermore, by extending the foot member of the pull tab into the V fold, the risk of premature separation of the foot member from the face of the tent side wall and/or the side wall of the ridge is minimised.

If desired, the distal end of the pull tab can have a triangular shape so that the apex of the triangle is in register with that portion of the ridge seal between the apexes of the V folds in the ridge structure when the pull tab is secured in position. This serves to localise the initial transverse force applied by the pull tab at this portion of the seal.

If desired, the exposed faces of the foot members of the pull tab to be located between the opposing faces of the dry walls in the V folds and/or the exposed face of the pull tab when secured in position can be coated with or rendered abhesive to reduce adhesion between the exposed face of the pull tab and the wall material and to introduce a zone of weakness into the ridge seal between the dry walls of the container in the V folds.

The pull tab can be made by any suitable technique, for example by cutting a suitable shape from a sheet material using a die, roller, air blade or other cutter. The material is preferably one which can be fused to the underlying material of the container, notably a composite material having one face thereof formed from a thermoplastic material, eg. a PVC or a polyalkylene, which can be fused to the plastic coating usually applied to the exterior face of the material from which the container is made, for example during the formation of the ridge seal by heat sealing. Preferably, the composite material is a laminate of a food grade polyethylene upon a polyester.

However, it is within the scope of the present invention for the pull tab to be secured to the container or blank by adhesive, in which case the material from which the pull tab is cut can carry adhesive on that face to be applied to the wall. This adhesive is preferably a pressure sensitive or contact adhesive, for example a PVA type of adhesive, and may be protected by a siliconised paper layer until the pull tab is applied. As indicated above, the other face of the pull tab may carry abhesive, for example a silicone, on selected areas and this can be applied by any suitable technique. Where the pull tab is to be applied using label application techniques and equipment, it may be preferred to form the pull tab from a continuous ribbon of a suitable material, eg. of the composite polyethylene/polyester, in which the pull tab outline is not fully cut from the ribbon so as to form a continuous length of material from which the individual pull tabs can be separated at the time of application to the container material. Such partial separation can be by way of incomplete cutting of the profile of the pull tab so as to leave uncut segments, or the cutter can be set so as not to cut through the siliconised paper or other backing so that the individual pull tabs are cut but remain on the backing for transport to the application station.

The pull tab can be applied to the container or blank by any suitable technique. Since the pull tab will usually be in the form of a thin planar member, it readily lends itself to application using label application machinery.

The pull tab can then be secured to the face of the blank from which a container is to be manufactured at any suitable point during the formation of the blank. Alternatively, the pull tab can be secured to the partially assembled container formed by forming the blank into a tube upon a mandrel or other support. The pull tab may also be secured to the container after it has been fully assembled or filled as part of or subsequent to the closure process in which the ridge seal is formed. However, it will usually be preferred to apply the pull tab to the plastic, card or plastic coated card blank from which the container is subsequently assembled. Such a blank can be of conventional form, but will preferably carry additional fold or crease lines formed in it to assist bowing of the ridge seal and tent side wall at the desired positions. It may also be desired to indent the container wall material at the location at which the pull tab is to be applied so that the pull tab is recessed into the wall material, for example by passing the blank through the nip of a pair of rollers or by applying sufficient pressure during the heat sealing attachment of the pull tab to the blank to cause partial crushing of the underlying material of the blank. This may avoid excessive thickness of the combination of the pull tab and container wall at this location, which might affect the feeding of the tabbed blank through conventional container assembly machinery.

As stated above, the pull tab may be secured to the container or blank by adhesive, notably where the pull tab is applied by a label application machine. However, it is particularly preferred to secure the pull tab in position by a heat sealing technique in which the thermoplastic surfaces of the container wall material and of the pull tab are fused together. In this case it may be desired to apply the pull tabs individually from a suitable magazine rather than from a moving continuous web, and to secure the pull tab in position by a spot of adhesive prior to the application of the hot die heat sealer.

If desired, the free, proximal, end of the pull tab can be folded and/or tack welded or otherwise secured to the container or blank wall during or after securing the pull tab to the wall so that it lies against the face of the wall and does not project. This minimises the risk of contamination and/or accidental snagging and operation of the pull tab during handling, but can be readily released by a user to spring the proximal end of the pull tab away from the wall of the container to assist gripping of the free end of the pull tab by a user.

The heat seal or other anchorage between the tent side wall and/or the ridge side wall and the material of the foot members of the pull tab will usually be sufficient to ensure that the foot members of the pull tab do not separate from the container wall or seal, notably where the pull tab is made from a polyethylene/polyester laminate. However, it may be desired to locate the foot members of the pull tab in register with the ridge seal and to fold over a portion of the tent side wall which extends axially beyond what is to be the upper edge of the ridge seal so as to form a channel within which the foot members are located. The folded over extension of the tent side wall is then secured to the material forming the ridge seal by a heat seal or other means to form a sleeve within which the foot members of the pull tab are trapped. In a particularly preferred embodiment, the foot members of the pull tab have a smaller plan size than the ridge seal against which they are to be secured and the folded over portion of the tent side wall is secured in position to trap the foot of the pull tab by the same heat sealing operation as is required to form the ridge seal.

To open a sealed container carrying a pull tab of the invention, the user grips the free end of the proximal end of the shank member of the pull tab, rolls his hand downwardly until his knuckle engages the tent side wall of the container and then rolls his hand about the knuckle contact to apply a transverse separation force to the ridge seal to open the container. As the container is opened by separation of the ridge seal, the tent side wall upon which the pull tab acts bows laterally outward and provides a spout type outlet to the container as wall as transmitting the separating force applied by the pull tab progressively along the length of the ridge seal, thus enabling the whole length of the seal to be separated. Where the foot members of the pull tab extend into the V fold of the ridge seal, this applies a lateral force parallel to the line of the ridge seal, thus further aiding initial bowing of the ridge seal and the tent side wall and separation of the ridge seal.

The surfaces of the spout which are contacted by the discharging contents of the container are those of the wet walls which have been bonded together during sealing of the container and have not been exposed to external contamination during storage and transport prior to opening of the container. Furthermore, since at least part of the pull tab is usually connected to the tent side wall immediately below the line of the ridge seal, the force applied to the pull tab will usually initially cause separation of the ridge seal from its base within the container, thus further reducing the risk of contamination as the ridge seal is separated. The containers of the invention can therefore be manufactured and filled under sterile or clean conditions so that, when the container is opened and discharged, the contents are not subjected to contamination from contact with the newly exposed surfaces of the spout. The container can therefore be used for the packaging of foodstuffs and other materials which require to be held under sterile conditions and which must be subjected to the minimum of contamination during discharge from the container.

The invention thus provides a simple and effective solution to the problem of opening a boxed end openable container without the need to modify the container manufacturing or filling process significantly, thus enabling the invention to be applied to conventional equipment. Alternatively, the pull tab can be applied to an assembled or sealed container using any suitable machine located at the end of the container assembly, sealing or filling line.

The invention has been described above in terms of the use of a single pull tab. However, it will be appreciated that more than one pull tab can be provided symmetrically disposed along the length of the ridge seal about the mid-point of the length of the ridge seal. For example, the container can be provided with two pull tabs, located one to each side of the ridge seal of the sealed container to enable a user to open the container by pulling on both pull tabs in opposite directions.

BRIEF DESCRIPTION OF THE DRAWINGS

To aid understanding of the invention, a preferred form thereof will now be described by way of illustration and with respect to the accompanying drawings, in which.

DETAILED DESCRIPTION OF THE INVENTION

A boxed end openable container comprises a generally rectangular or square main body portion, whose bottom has been closed by conventional box folds or other means, and which contains milk, fruit juice or other fluid or a fluent powder. The container is made from a wax or plastic, notably polyethylene, coated paper or card so that it can readily be folded along score lines or the like formed in a sheet blank from which the container is made and the folded configuration secured in place by heat sealing or otherwise adhering the overlapping edge portions of the assembled container. Alternatively, the container can be made by blow or extrusion moulding from a suitable plastic so that the container is formed as a unitary article with an open top which can then be folded to form a ridge structure as described below.

The upper portions of the side walls of the container are folded in upon one another to form a conventional boxed end. In such an operation a V fold is formed in each of two opposed side walls with the apex of each V directed towards the centre line of the container. This has the effect of bringing the top edges of the other two side walls together to form a tented end to the container. The top edges of the side walls lie against one another to form a ridge lying along a transverse line extending along the line of indentation of the V folds. The edges are sealed together by applying heat and pressure using a conventional heat sealing bar or the like to form a comparatively deep transverse seal closure along the ridge. The depth of the seal is sufficient to incorporate the upper edges of the V folded walls to ensure a fluid tight closure.

A pull tab is secured by a heat seal or suitable adhesive to the tent side wall material which is to form part of the gabled end of the container. Preferably, the pull tab is cut from a sheet of a polyethylene/polyester laminate and is secured to the tent side wall by fusing of the opposed polyethylene faces using a conventional heat sealer. The free, or proximal end of the shank member of the pull tab can have a finger hole, transverse ribs or other grip assisting means formed therein to aid gripping of the pull tab by a user. If desired, the free end of the proximal end of the pull tab can be secured in position against the tent side wall of the container by a tack seal or other separable means so that the pull tab is not accidentally pulled during handling of the container.

The pull tab is formed with laterally extending feet at the distal end of the axial shank portion by which the pull tab is secured by a heat sealing technique to the wall of the container.

Figure 1:
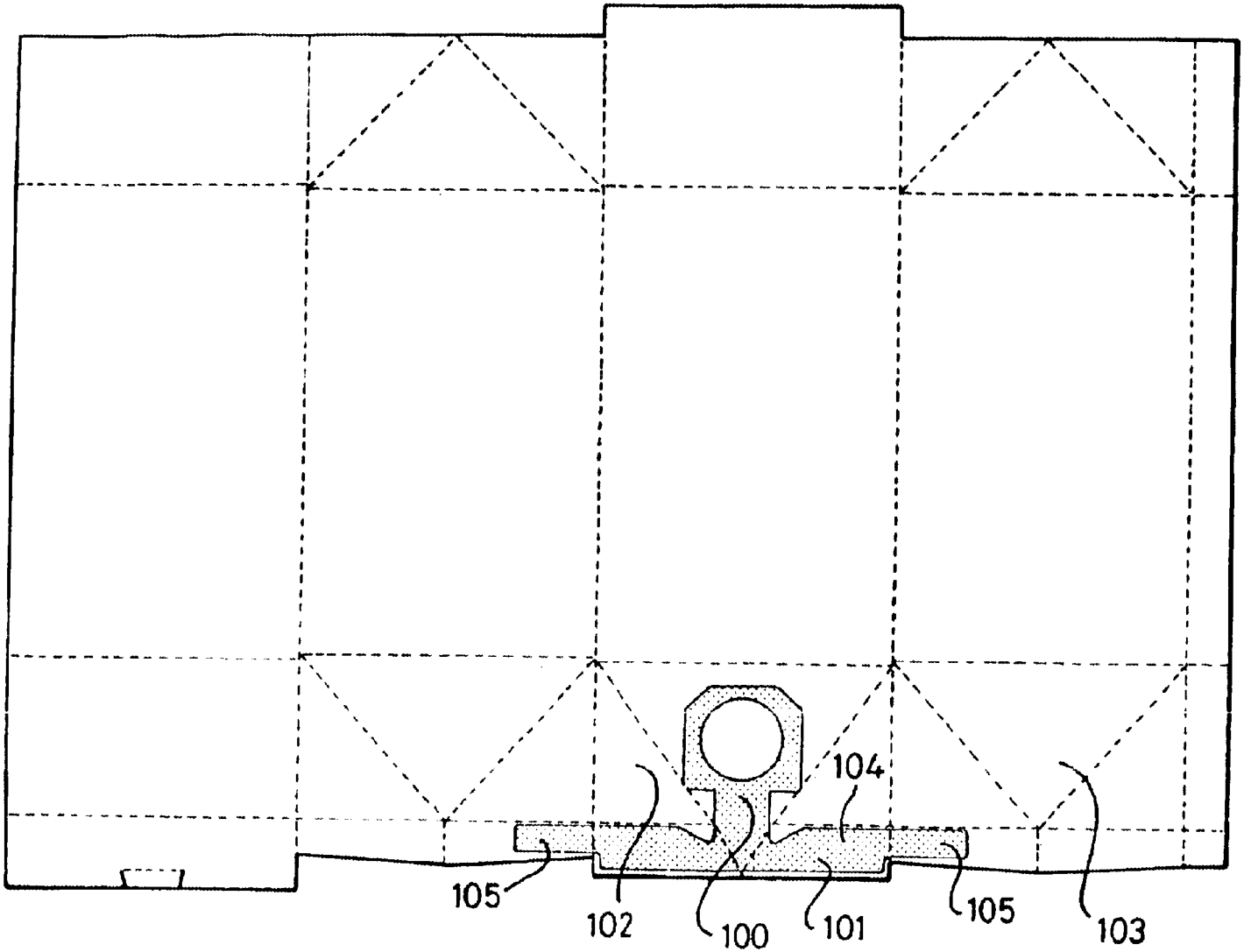
FIG. 1 is a plan view of a blank for use in the manufacture of a boxed end container carrying a pull tab of the invention.

Such a container is made from a blank as shown in FIG. 1. The pull tab has an axially extending shank 100 with feet 101 at the distal end of the shank. The feet extend laterally to each side of the axis of the shank 100 and have extensions 104 extending axially toward the proximal end of the shank member 100. The included angle between the proximal edge of the foot member and the longitudinal edge of the shank member is in this case about 30° The feet 101 also have lateral extensions 105 which extend beyond the transverse extent of the panel 102 which is to form the tent side wall of the assembled container. During manufacture of the container, the extending portion 105 is folded around the edge of tent side wall 102 to extend between the opposed faces of the gable end wall 103 which is folded in a V fold when the ridge construction of the container is formed. The extensions 105 of the feet 101 are thus incorporated into the ridge seal construction. When the pull tab is pulled, this applies a force to bow the wall 102 of the container and the portions 105 of the feet 101 extending around the two opposed corners of wall 102 apply a lateral pressure parallel to the line of the ridge seal and a peel force to separate the opposed faces of wall 103 in the V fold of the ridge seal construction, thus assisting separation of the ridge seal and the bowing of wall 102 to form the spout outlet to the opened container.

Figure 2:
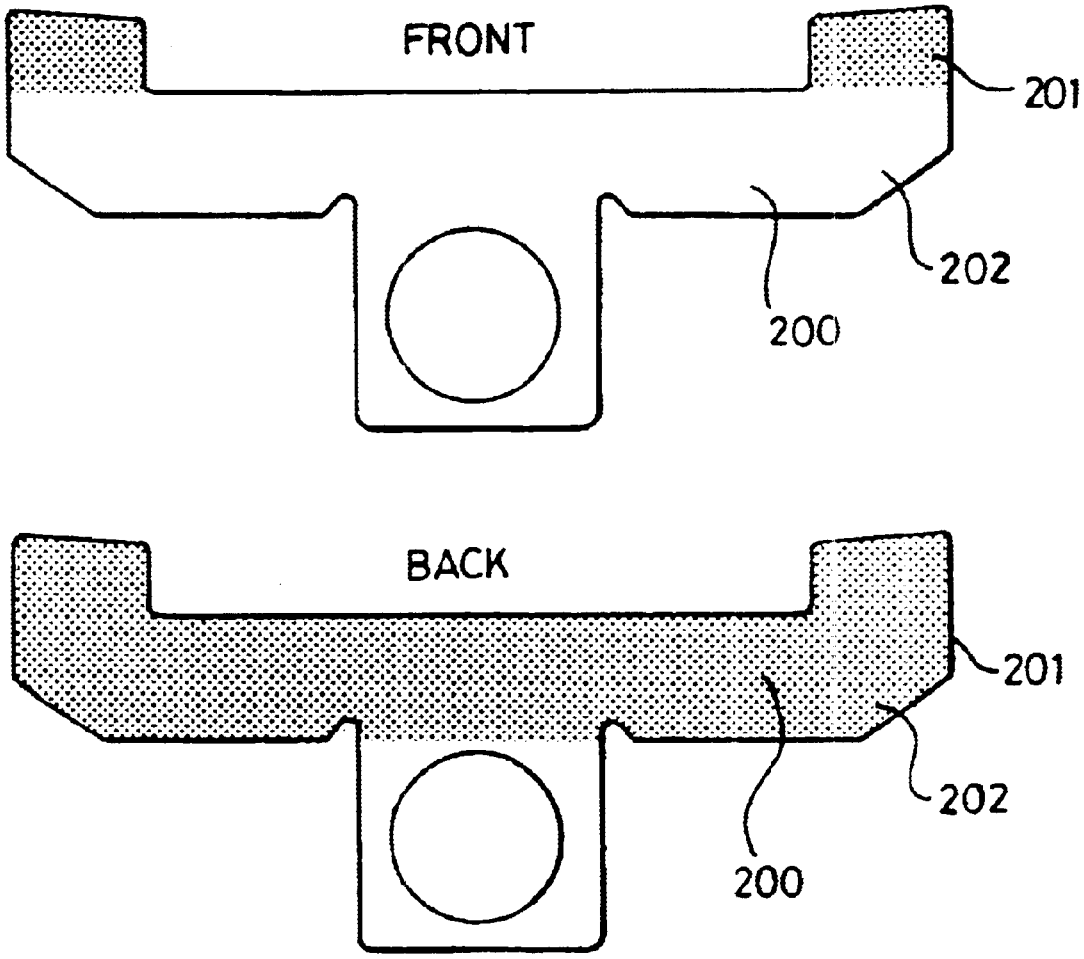
FIG. 2 is a plan view of an alternative form of the pull tab of FIG. 1.

In the alternative form of pull tab shown in FIG. 2, the feet 200 have axial extensions 201 which extend upwardly, distally, as well as the axial extensions 202 which extend downwardly, proximally. In this case, the included angle between the proximal edge of extensions 202 where they join the shank member and the longitudinal edge of the shank is about 60°. The extensions 201 lie within the interface between the walls of the gabled end forming the V fold when the pull tab is applied to the container. These extensions impart a zone of weakness to the ridge seal, even when the pull tab is mounted with the lateral portions of the feet 200 mounted on the tent side wall and not within the side wall area of the ridge seal. As shown in FIG. 2, the areas of the pull tab to be located within the seal structure and opposed to one another can have an abhesive applied to them, shown as shaded areas in FIG. 2, to reduce adhesion of the container wall material to those areas.

Figure 3:
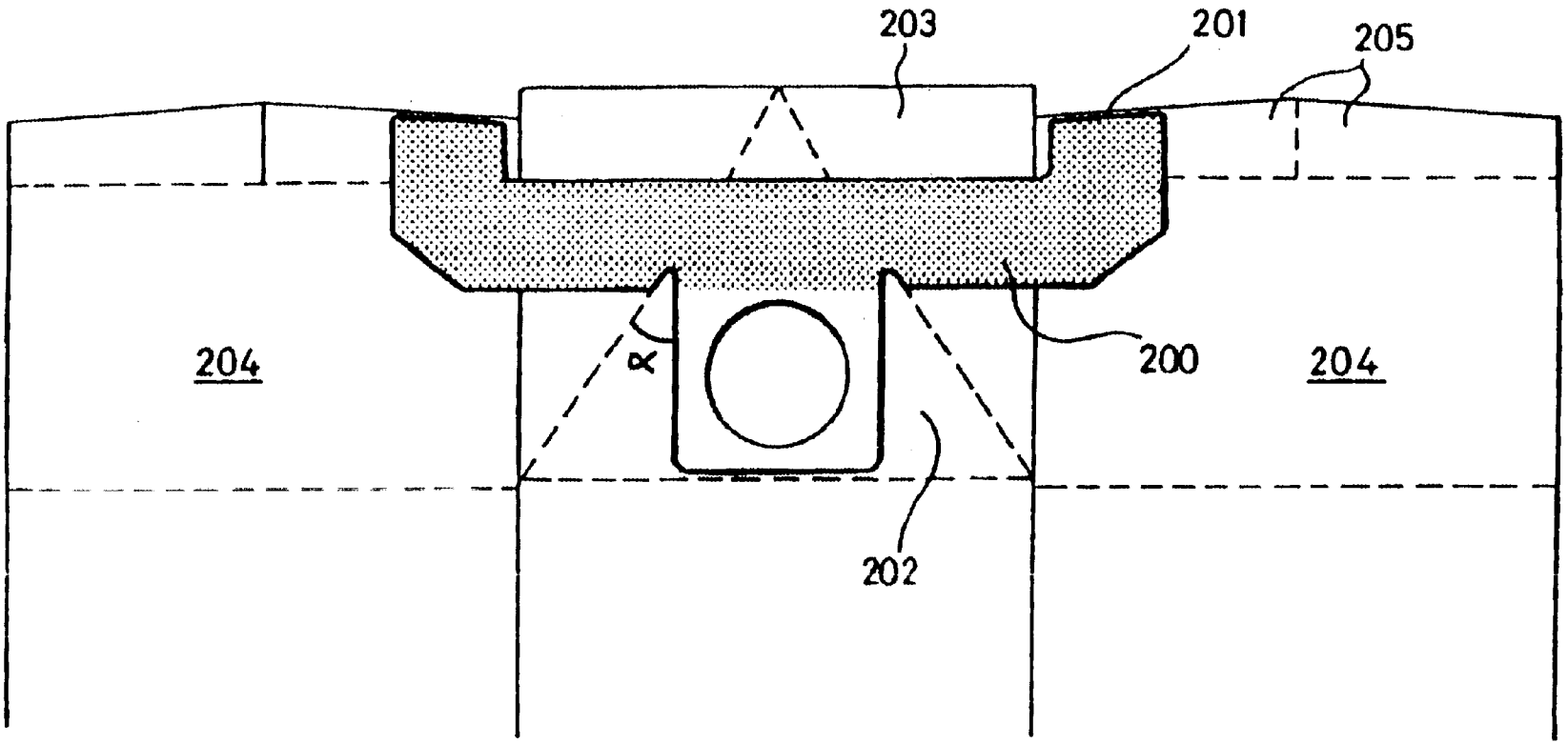
FIG. 3 shows the pull tab of FIG. 2 upon a container blank.

FIG. 3 shows the pull tab of FIG. 2 secured to a blank. The pull tab is secured to that panel of the blank which is to form the tent side wall 206 of the assembled container, with the upper edge of feet 200 lying adjacent the foot of the material 203 which is to form part of the ridge seal. The axial extensions 201 to feet 200 lie within that part of panels 204 and 205 which are to form the dry wall faces of the V folds of the gabled ends of the assembled container.

Figure 4:
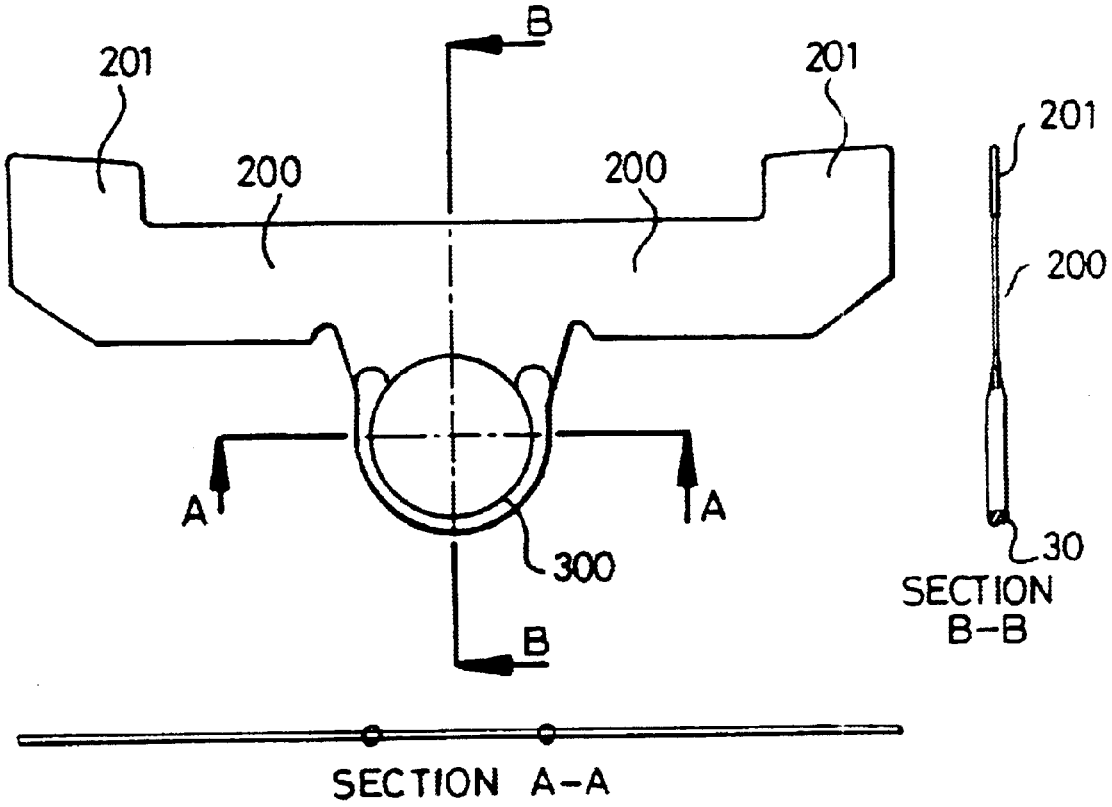
FIG. 4 shows an alternative form of the pull tab of FIG. 2.

As shown in FIG. 4, the pull tab of FIG. 2 can be formed with a thickened proximal end to give a ring pull 300.

Figure 5:
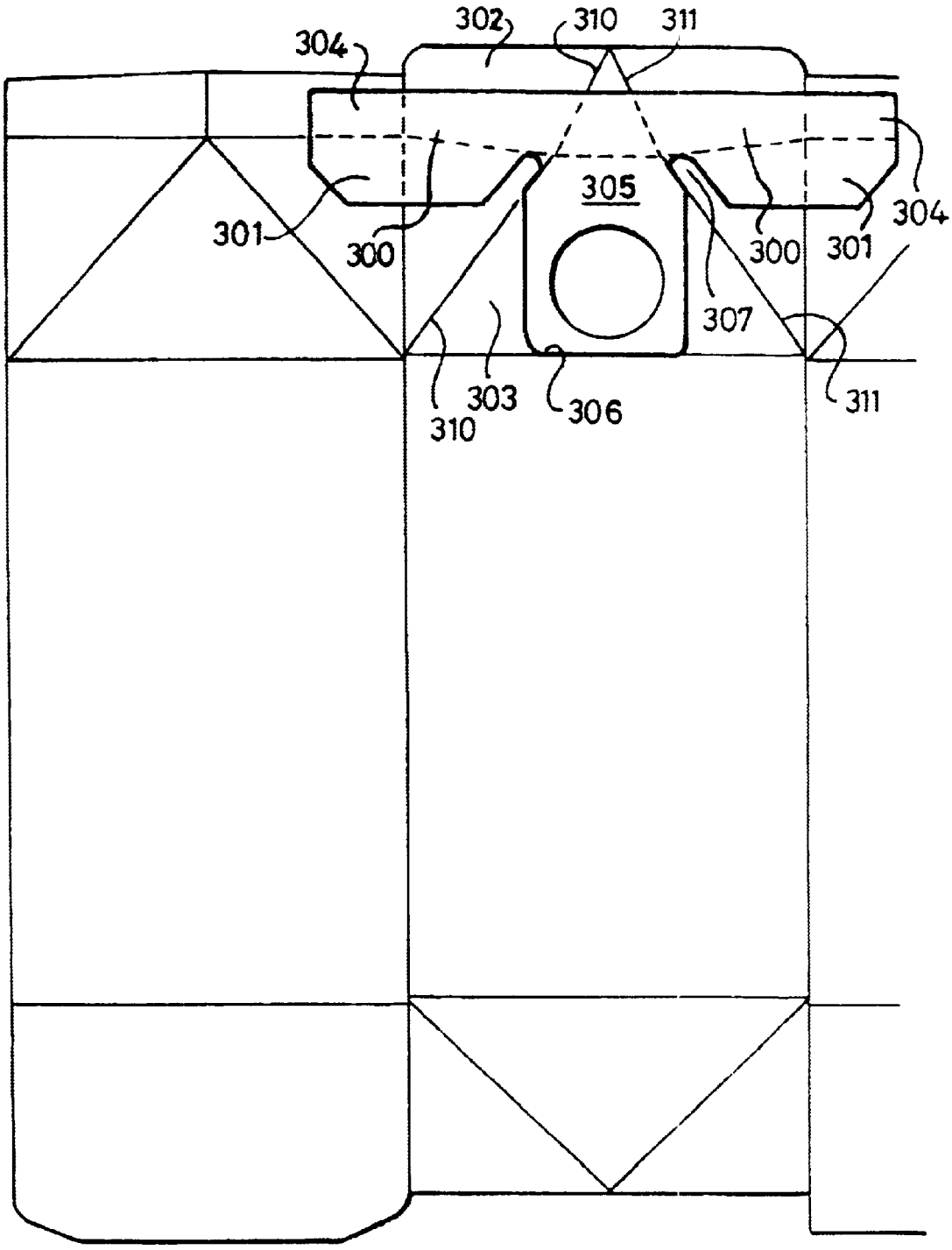
FIG. 5 shows an alternative form of the pull tab of FIG. 1 secured to a container blank.

FIG. 5 shows a further alternative form of pull tab mounted upon a blank used to form a container. In this form of pull tab, the feet 300 have enlarged proximally extending axial extensions 301 which extend axially over the side wall of the ridge 302 and downwardly over part of the adjacent tent side wall 303 of the container when assembled from the blank. In 5this case the included angle between the proximal edge of the extension 301 and the longitudinal edge of the shank where the extensions 301 join the shank is about 45°. The lateral extensions 304 of the feet 300 extend beyond the ends of the ridge and into what will be the V folds of the gabled end of the assembled container. As shown, the blank has fold lines 310 and 311 formed in it extending from the mid-point of what will be the upper edge of the ridge seal down to the outer corners of what will be the base of the tent side wall 303. The shank 305 and head 306 of the pull tab are located within the resultant triangle of material bounded by the fold lines 310 and 311. The pull tab is provided with stress relief curves 307 at the intersections of the longitudinal edges of the shank 305 and the proximal edges of feet 300 which also allow the head 306 to be lifted away from the face of the tent side wall 303 for gripping by a user. The pull tab is secured to the blank by heat sealing the feet 300 and the extensions 301 and 304 to the blank using a heat sealer die. If desired, the pull tab can be secured in position using adhesive.

While the invention has been shown in only one of its forms, it is not thus limited but is susceptible to various changes and modifications without departing from the spirit thereof.

What is claimed is:

1. A generally planar pull tab suitable for affixing to an exterior of a wall of a boxed end openable container having one end closed by bonding together opposing faces of the wall material so as to form a seal closure to the container, or for affixing to a blank for use in the manufacture of such a container, and by which pull tab a force can be applied by a user to the seal of such a container carrying the pull tab to apply a transverse separating force to the seal closure of the container and thus cause separation of the seal to open the container and thus permit discharge of the contents of the container, characterized in that the pull tab comprises:

a. a shank member extending longitudinally between a proximal end adapted to be grasped by a user and distal end adapted to be secured to a wall of the container or the blank, said shank member having two longitudinally extending edges thereto;

b. at least two foot members by which the distal end of the shank member is adapted to be secured to the wall of the container or of the blank, said foot members extending transversely one from each of said longitudinal edges of the shank member to provide foot members extending substantially symmetrically from the distal end of the shank member, said foot members each having a proximal edge which extends from a point on the shank member intermediate the proximal and distal ends of the shank member;

c. the angle $\underline{\alpha}$ included between the said proximal edge of the foot member and the longitudinal edge of the shank member at the point where the foot member joins the shank member being less than 90°, whereby the foot member has a portion which extends axially towards the proximal end of the shank member with respect to the said point; and d. said pull tab being made from a sheet material having a surface which can be fused with or otherwise adhered to the material of said container or blank.

2. A pull tab as claimed in claim 1, characterized in that said proximal extension to the foot member has a triangular or part triangular shape.

3. A pull tab as claimed in claim 1, characterized in that it is made from a laminate of a polyalkylene and a polyester.

4. A pull tab as claimed in claim 1, characterized in that it is provided with stress relief curves at the intersections of the shank member and the proximal edges of the foot members.

5. A pull tab as claimed in claim 1, characterized in that the included angle between the proximal edge of the foot member and the longitudinal edge of the shank member is from 30 to 60°.

6. A boxed end openable container, characterized in that it has secured to a wall thereof a pull tab as claimed in claim 1.

7. A blank for use in the manufacture of a boxed end openable container, characterized in that it has secured to a wall thereof a pull tab as claimed in claim 1.

* * * * *